United States Patent [19]

Liston

[11] 4,319,662

[45] Mar. 16, 1982

[54] FIRE FIGHTING APPARATUS FOR A STORAGE/RETRIEVAL MACHINE

[75] Inventor: Novell D. Liston, Bountiful, Utah

[73] Assignee: Eaton Corporation, Cleveland, Ohio

[21] Appl. No.: 154,694

[22] Filed: May 30, 1980

[51] Int. Cl.[3] ..... E06C 5/32

[52] U.S. Cl. ..... 182/13; 74/661; 104/121; 105/147; 169/52; 180/2 R; 182/141; 182/63; 192/0.098; 192/48.9; 192/99 S

[58] Field of Search ..... 169/24, 52, 54, 70, 169/91; 182/12, 13, 14, 51, 52, 63, 83, 141, 148; 180/2 R, 2 A, 14 E; 104/118, 121; 105/26 D, 35 P, 141, 146, 147; 187/94; 74/661; 192/0.098, 48.9, 99 R, 99 S

[56] References Cited

U.S. PATENT DOCUMENTS

| | | | |
|---|---|---|---|
| 329,256 | 10/1885 | Bierbach | 182/51 X |
| 744,762 | 11/1903 | Johnston | 182/52 |
| 972,576 | 10/1910 | Scully | 182/51 X |
| 1,400,689 | 12/1921 | Lewis | 192/99 S X |
| 1,534,018 | 4/1925 | Ames | 105/147 X |
| 1,554,584 | 9/1925 | Lake | 182/14 X |
| 1,699,544 | 1/1929 | Rohlfing | 105/147 X |
| 3,406,795 | 10/1968 | Pickles | 192/0.098 X |
| 3,556,239 | 1/1971 | Spahn | 180/2 A X |
| 3,602,313 | 8/1971 | Achs | 169/52 |
| 3,738,429 | 6/1973 | Heller et al. | 169/54 X |
| 3,886,870 | 6/1975 | Pelabon | 105/34 P X |
| 4,178,994 | 12/1979 | Ito et al. | 169/52 |

*Primary Examiner*—Gil Weidenfeld
*Assistant Examiner*—Fred A. Silverberg
*Attorney, Agent, or Firm*—C. H. Grace; F. M. Sajovec

[57] ABSTRACT

A storage/retrieval machine (10) is provided with equipment to adapt the machine for use in fighting fires in a warehouse in which the machine is installed. A plurality of platforms (26, 30) and access ladders (28, 32) are provided along the length of the machine mast (14). A standpipe (34) having a connection (36) to a central fire extinguisher fluid source extends along the mast, and hose and nozzle assemblies (38) are provided at each platform. To provide power to the machine to move it to the location of the fire, an auxiliary drive motor (61) is mounted on the storage/retrieval machine, and an auxiliary power supply (46) mounted in a waterproof housing (48) and supported on its own wheels (50, 52), is engageable with the storage/retrieval machine for movement therewith.

6 Claims, 6 Drawing Figures

FIRE FIGHTING APPARATUS FOR A STORAGE/RETRIEVAL MACHINE

The present invention relates to high rise storage and retrieval systems, and more particularly to means for adapting such systems for use in fire fighting.

As in any warehouse or storage area there is a risk of fire even where fire prevention programs are well planned and well carried out. In the case of a modern high rise warehouse, it can be difficult to fight such fires because of the height of the warehouse and because of the limited access afforded by the narrow aisles generally provided between storage bays.

There are fire fighting systems adapted for use in warehouses in the prior art. For example, U.S. Pat. No. 3,738,429 discloses a system of overhead hoses which can be dropped down between aisles to fight fires in the storage racks, and U.S. Pat. No. 3,602,313 discloses a warehouse which includes a central foam generator and a foam generator mounted on a stacker crane.

While stationary sprinkler, hose or foam systems are generally effective in fighting warehouse fires, it may be necessary to concentrate the fire fighting effort in a particular section of the warehouse. A foam or other system mounted on a stacker crane or storage/retrieval machine would accomplish this, however, they require the use of cumbersome fire fighting equipment which may get in the way of the normal material handling elements of the machine, and in the event of a power failure in connection with a fire, they would not be usable.

It is thus an object of the present invention to provide means to quickly adapt a storage/retrieval machine for fire fighting, both as to equipment and as a means to transport fire fighting personnel to a fire. Another object of the invention is to provide portable power supply means to the storage/retrieval machine to enable a machine to traverse an aisle when the central power supply of the warehouse is cut off.

To accomplish the above objective the present invention provides a plurality of platforms attached to the mast of a storage/retrieval machine, and connected by ladders to provide fire fighters access to any level within the storage system. The storage/retrieval machine is also provided with a standpipe extending along the mast and includes appropriate valves and hoses at each level to allow a fire fighter to ascend the ladder to extinguish a localized fire. To enable the storage/retrieval machine to move along an aisle when the central power is cut off, the invention provides an auxiliary drive motor on the machine and an auxiliary power generator which can be hitched to the machine and used to provide power to the auxiliary motor.

Other objects and advantages of the invention will become apparent from the following description when taken in connection with the following drawings, wherein:

FIG. 5 is a front elevation view of the power unit shown in FIG. 4; and.

Figure 1:
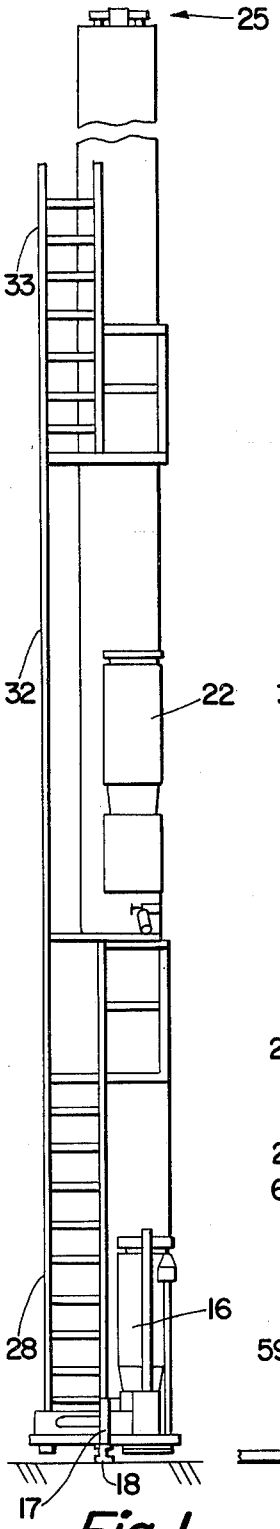
FIG. 1 is a rear elevation view of a storage/retrieval machine incorporating certain aspects of the invention.
Figure 2:
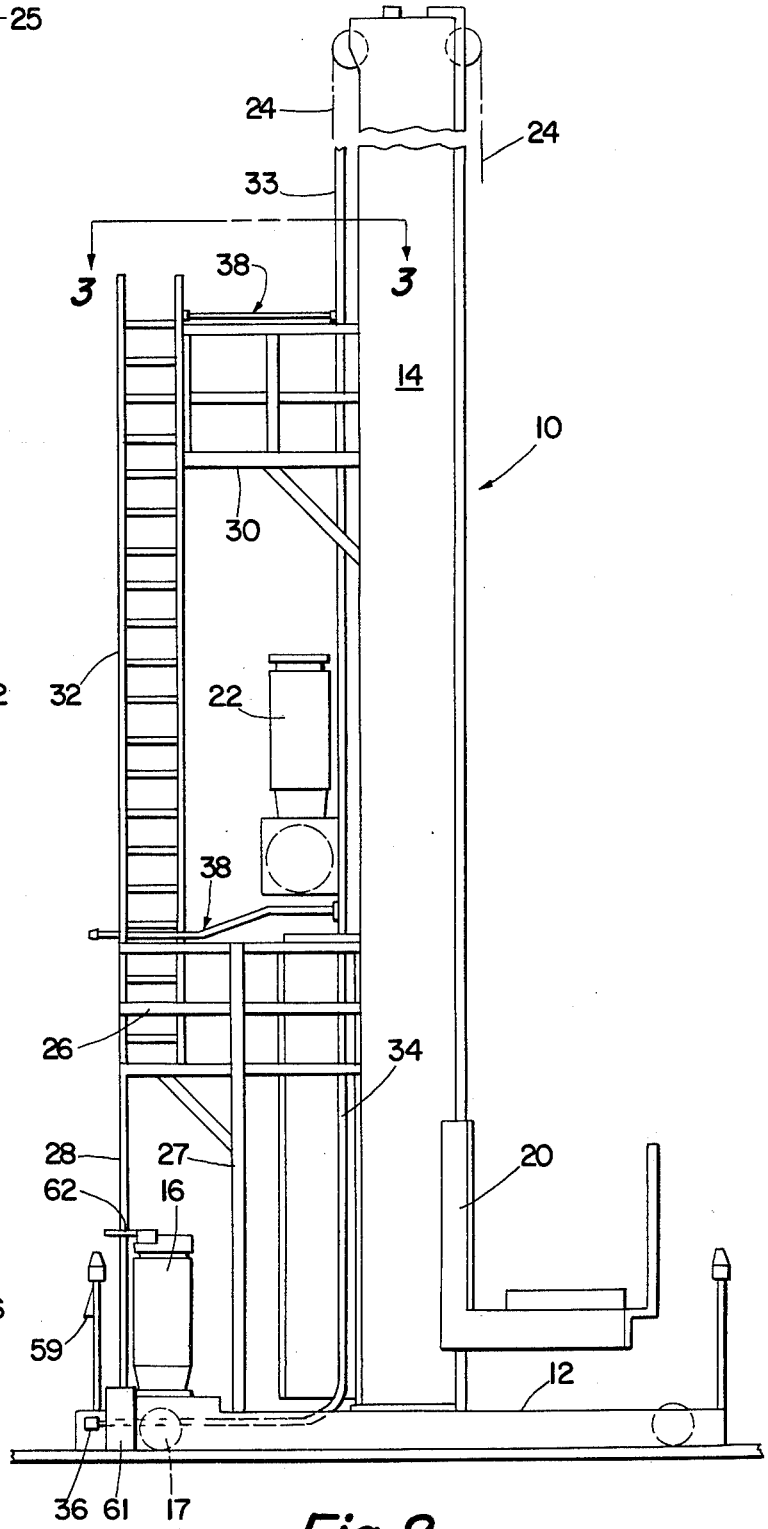
FIG. 2 is a side elevation view of the machine of FIG. 2.

Referring to FIGS. 1 and 2, there is illustrated a storage/retrieval machine 10, commonly referred to as an S/R machine, which comprises a base 12, a mast 14 upstanding from the base, a first drive unit 16 mounted on the base and connected to a drive wheel 17 to drive the S/R machine horizontally along a rail 18 running in an aisle between rows of storage bays in a high-rise warehouse, a load carriage 20 mounted for vertical movement along the mast 14, and a second drive unit 22 mounted on the mast and adapted to drive the load carriage vertically up and down the mast by means of a drive cable 24. The machine is stabilized by a guide assembly 25 mounted at the top of the mast and engageable with an overhead rail (not shown), the guide assembly also serving to connect the first and second drive units to a central power supply.

In accordance with known practice in the art, the S/R machine 10 is further provided with a first platform 26 attached to the mast 14 adjacent the second drive unit 22 and supported on the base 12 by support posts 27. The platform is accessible from the base by means of a ladder 28 to provide access to the second drive unit for service and repair.

In accordance with the invention one or more additional or second platforms 30 are mounted several feet further up the mast from the first platform, and are accessible by means of ladders 32 and 33 extending from the lower platform. It can be appreciated that the height of the mast 14 is determined by the height of the warehouse in which the S/R machine is installed, and that additional second platforms 30 and access ladders 32 and 33 may be provided for access to the full length of the mast 14.

Also in accordance with the invention, a standpipe 34 is installed along the mast 14 and includes a connector 36 at the base level for connection to a central water or fire extinguisher supply, and fire hose and nozzle assemblies 38 at each of the platforms 26 and 30 to provide means for fire fighters to extinguish fires in storage bays extending to the full height of the warehouse.

Figure 3:
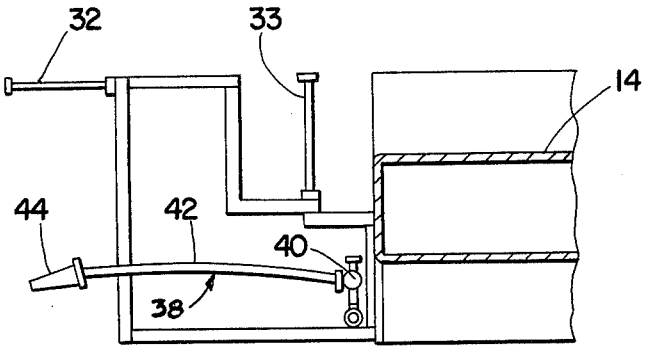
FIG. 3 is a section view taken along line 3—3 of FIG. 1.

As shown in FIG. 3, a valve 40 is connected to the standpipe 34 at each platform and a hose 42 of the hose and nozzle assembly is connected to the outlet of the valve. For normal operation of the S/R machine the nozzle 44 can be removably supported in an out-of-the-way position by means (not shown) on the platform.

In the event of a fire in a storage bay, the standpipe 34 is connected to a central water supply or to a foam generator by means of the connector 36. The S/R machine is then driven along the track to the location of the fire where fire fighters man the hose and nozzle assemblies 38 at the platforms 26 and 30.

In accordance with a further aspect of the invention, it is appreciated that if a fire occurs, it is likely that the central power supply normally used to power the S/R machines will be cut off. Accordingly, the invention provides an auxiliary power supply unit, designated generally by the numeral 46, which can be hitched to the S/R machine and which is capable of supplying power to move the S/R machine along the rail 18 to the location of a fire.

Figure 4:
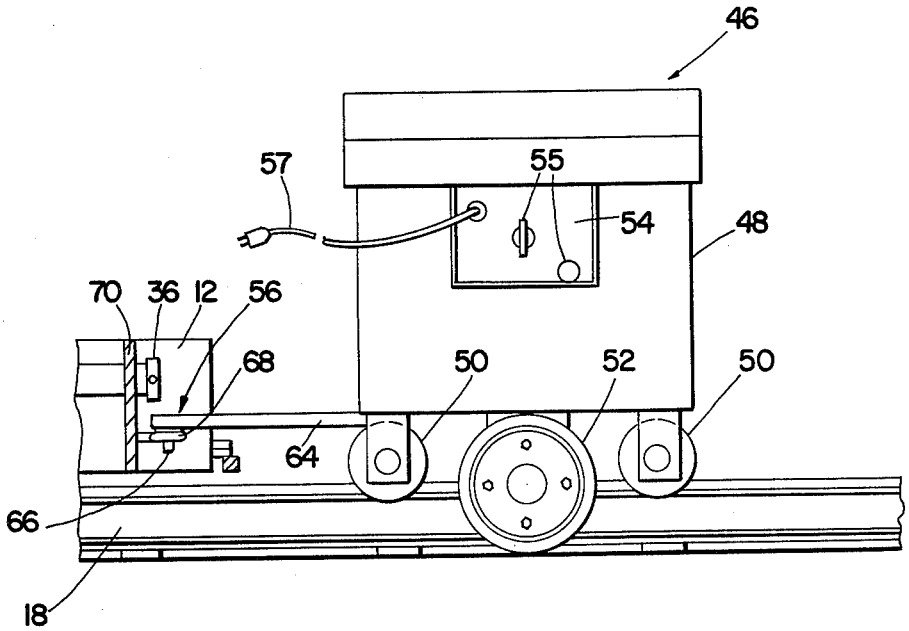
FIG. 4 is a side elevation view of an auxiliary power unit of the invention.
Figure 5:
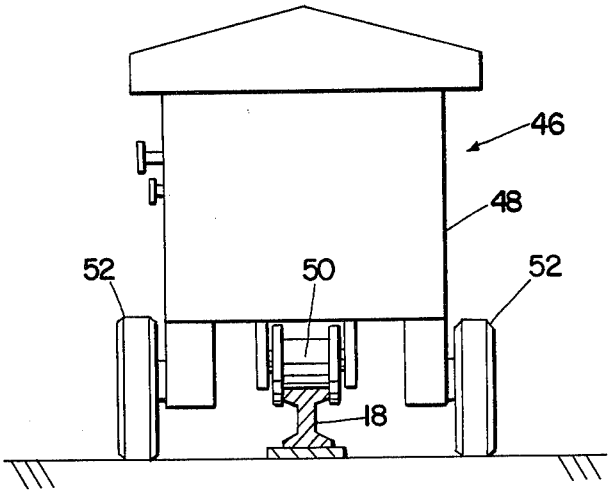

Referring to FIGS. 4 and 5, the auxiliary power unit comprises a waterproof housing 48, a pair of first support wheels 50 mounted for rotation on the frame and adapted to ride on the rail 18, and second support wheels 52 mounted for rotation on the frame and engageable with the warehouse floor, a control panel 54 mounted on the frame and accessible by an operator standing on the warehouse floor, and a hitch assembly 56 extending horizontally from the frame and engageable with the base 12 of the S/R machine.

The auxiliary power supply unit preferably comprises a known type of gasoline or diesel engine powered generator set and will not be described in detail herein. The control panel 54 includes starting and operating controls 55 for the generator, and a power cord 57 which connects to a waterproof receptacle 59 on the frame 12 of the S/R machine. It can be appreciated that the auxiliary power supply unit can also comprise one or more storage batteries.

Figure 6:
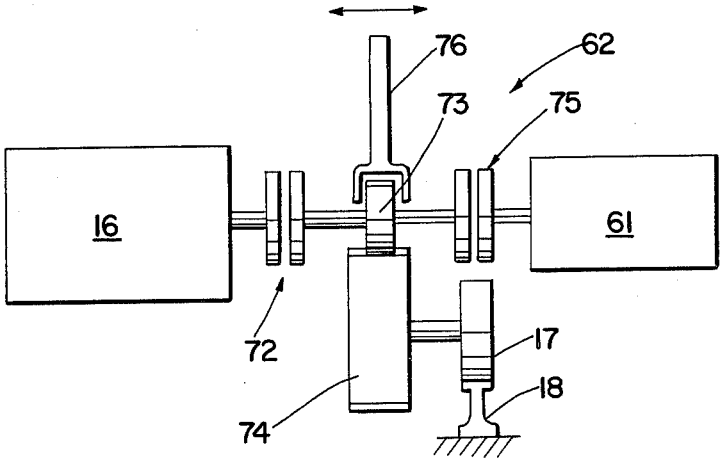
FIG. 6 is a schematic representation of engagement means for an auxiliary drive motor of the invention.

To move the S/R machine on auxiliary power, an auxiliary drive motor 61 is mounted on the frame 12 and is operatively connected to the drive wheel 17, and manual engagement means 62 are provided on the S/R machine to disengage the drive motor brake and engage the auxiliary drive motor. FIG. 6 schematically illustrates one form of engagement means, depicted in a neutral position, which can be used. The first drive motor 16 is connected to the drive wheel 17 through a first clutch 72, a pinion gear 73, and a drive gear 74. The auxiliary motor 61 is also connected to drive wheel 17 through a second clutch 75, and to pinion 73 and drive gear 74. In the schematic embodiment illustrated, the pinion 73 can be moved from side to side by means of a control yoke 76 such that movement of the yoke to the left as shown engages the first clutch 72 and thus the first drive motor 16, while movement of the yoke to the right engages second clutch 75 and thus the auxiliary motor 61. It can be appreciated that in actual practice the engagement means 62 would be provided by a known form of commercially available power transmission equipment operating generally along the illustrated principle to shift from a main prime mover to an auxiliary prime mover.

The hitch assembly 56 comprises a yoke or bar 64 having a pin 66 attached to the free end thereof for engagement with an eye 68 attached to an end plate 70 of the S/R base 12.

In the event of a fire which results in the loss of central power, the auxiliary power supply unit 46 can be moved to a position adjacent the S/R machine, hitched to the machine and connected to the auxiliary motor by plugging the power cord 57 into the receptacle 59. The engagement means 62 can then be actuated to engage the auxiliary motor to drive the machine along an aisle to the location of a fire, where fire fighters can man the hose and nozzle assemblies 38 on the platforms 26 and 30.

I claim:

1. In a storage/retrieval machine comprising a base, a mast upstanding from said base, a floor-engaged drive wheel rotatably mounted on said base, and a first drive motor operatively connected to said drive wheel; a plurality of horizontal platforms mounted on said mast and spaced apart therealong, a first ladder extending from said base to a first of said platforms, one or more second ladders extending between platforms, a standpipe extending along said mast, a fire hose and nozzle assembly received at each of said platforms, valve means accessible from each of said platforms and connecting said fire hose and nozzle assemblies to said standpipe, means connecting said first drive motor to a central source of electrical power, an auxiliary drive motor mounted on said base, auxiliary electric power supply means independent of said centraL source and selectively engageable with said storage/retrieval machine for movement therewith along said floor, means connecting said auxiliary drive motor to said auxiliary power supply means, and means on said base for selectively engaging and disengaging said auxiliary drive motor with said drive wheel.

2. Apparatus as claimed in claim 1, in which said means for selectively engaging and disengaging said auxiliary drive motor includes means for simultaneously disengaging said first drive motor when said auxiliary drive motor is engaged and engaging said first drive motor when said auxiliary drive motor is disengaged.

3. Apparatus as claimed in claim 1, in which said auxiliary power supply means comprises a waterproof housing, a first support wheel rotatably mounted on said housing and engageable with a guide rail mounted on said floor, a second support wheel rotatably mounted on said housing and engageable with said floor, electric power generating means received within said housing, and means for attaching said housing to said storage/retrieval machine.

4. Apparatus as claimed in claim 3, including control means mounted on said housing and accessible from outside said housing for controlling the electrical output of said generating means.

5. Apparatus as claimed in claim 3, in which said generating means comprises an internal combustion engine and rotary generator set.

6. Apparatus as claimed in claim 3, including power cord and receptacle means connecting said generating means with said auxiliary drive means.

* * * * *